US005536192A

United States Patent [19]

Byun

[11] Patent Number: 5,536,192

[45] Date of Patent: Jul. 16, 1996

[54] METHOD FOR MEASURING CONVERGENCE OF A COLOR CATHODE RAY TUBE AND APPARATUS THEREOF

[75] Inventor: Sang-doo Byun, Suwon-city, Rep. of Korea

[73] Assignee: Samsung Electronics Co., Ltd., Kyungki-do, Rep. of Korea

[21] Appl. No.: 478,018

[22] Filed: Jun. 7, 1995

[30] Foreign Application Priority Data

Jul. 29, 1994 [KR] Rep. of Korea ..... 94-18717

[51] Int. Cl.[6] ..... H01J 9/42

[52] U.S. Cl. ..... 445/3; 445/63

[58] Field of Search ..... 445/4, 3, 63, 64

[56] References Cited

U.S. PATENT DOCUMENTS 4,925,420 5/1990 Fourche et al. ..... 445/63

FOREIGN PATENT DOCUMENTS 61-211935 9/1986 Japan ..... 445/4

5-28923 2/1993 Japan ..... 445/63

6-203757 7/1994 Japan ..... 445/63

*Primary Examiner*—P. Austin Bradley

*Assistant Examiner*—Jeffrey T. Knapp

*Attorney, Agent, or Firm*—Burns, Doane, Swecker & Mathis

[57] ABSTRACT

In a method of measuring convergence of a CRT and apparatus in use for implementing the same, the convergence can be adjusted more easily by measuring misconvergence using dot patterns so as to minimize the influence of position control, graphically processing the amount of the measured misconvergence and displaying the misconvergence state. It is not necessary to control precisely the relative position of a target CRT for measurement of convergence and the cameras used for measurement. Therefore, in measuring the convergence of a CRT, on each measurement of convergence of a new CRT, the operator does not need to readjust the relative position of a target CRT for measurement of convergence with respect to the cameras used for the measurement.

14 Claims, 6 Drawing Sheets

METHOD FOR MEASURING CONVERGENCE OF A COLOR CATHODE RAY TUBE AND APPARATUS THEREOF

BACKGROUND OF THE INVENTION

The present invention relates to a method for measuring the convergence of a color cathode ray tube (CRT) and apparatus thereof, and more particularly, to a method for measuring the convergence, in which the influence of a relative position control with respect to the target CRT for measurement and the apparatus used in measuring the convergence can be minimized, and an apparatus for implementing the same.

In general, in a process for manufacturing a color CRT used as a display device such as a color television receiver or a color monitor, in order to reconstruct clearly the color of an image to be displayed, convergence is necessary so that the three primary color electron beams (R, G and B beams) emitted from a triple electron gun are adjusted to focus on a pixel point of a CRT screen at different incident angles.

The convergence is usually classified into static convergence which is adjusted for overall misconvergence (the center of an image) and dynamic convergence which is adjusted for partial misconvergence (the peripheral portion of an image).

Because of the need for convergence in the conventional color CRTs, to produce a good convergence state of the three electron beams on the screen, a strong pin cushion-like horizontal deflection magnetic field and a strong barrel-like vertical deflection magnetic field are created in the deflection yoke installed between the triple electron gun and the screen. The direction of the three beams is changed via these magnetic fields, to converge on the screen.

However, in practice, the electron beams emitted from the electron gun of a CRT are deflected by the deflection yoke installed in the neck portion of the CRT to produce raster on the screen. This causes a bad screen state such as misconvergence or generates electron beam landing due to the minuteness of assembly of the deflection yoke or CRT, instrument mechanical error or curvature difference of the CRT panels.

Japanese Patent laid-open publication No. Hei 3-217192 discloses a conventional convergence measuring apparatus for measuring and adjusting convergence, an extracted portion of which is shown in FIG. 1.

Referring to FIG. 1, the conventional convergence measuring apparatus includes a camera 12 for reading an image, a signal source 11 for generating cross-hatch pattern on a CRT 10, a digital filter 13 for separating the image read by camera 12 into red (R), green (G) and blue (B) beams, a set of memories 14 for storing each separated picture and a monitor 15 for display the stored picture in each memory 14.

The conventional convergence measuring apparatus having the aforementioned structure measures misconvergence such that cross-hatch pattern is generated on the screen of the target CRT for convergence measurement, the images of the local parts of an imaged region are read by the camera 12 and then the luminance centers of the R, G and B beams is extracted.

Also, as shown in FIG. 2, in order to measure the misconvergence of horizontal and vertical R, G and B beams, a horizontal window 10*h* and a vertical window 10*v* are set on the screen of the target CRT and the luminance of each internal R, G and B beams is calculated by a gravity center method to then be extracted.

The extent of measured convergence by the aforementioned measuring method and apparatus thereof is ordinarily within 20 μm. Since the local parts of the screen of the CRT are imaged by a camera in order to increase the measuring preciseness, it is necessary to control the positions of the camera and the target CRT set for measurement of convergence.

However, when a color CRT is manufactured in practice, the process of measuring and adjusting the convergence thereof is generally performed in the state where a set of an assembly composed of a CRT and printed circuit board (to be called "CRT set" hereinafter) is put on a conveyer in its entirety by a predetermined device.

A position error of about 2 mm is practically generated either forwards or backwards, left or right and up or down, in controlling the position of the CRT set put on the conveyor as described above. Also, a position error of about 3 mm is generated during the adjustment depending on the horizontal and vertical position with respect to the curvature surface of the CRT screen and its size. In consideration of the partial imaged region of the CRT screen, which is about 10 mm, even such a minute positional error disables precise position control. Moreover, if the position control is incorrect due to an ambient factor such as a vibration or shock, the cross-hatched patterns of a predetermined region in the screen of the CRT are then outside the imaged region of the camera, thereby preventing the camera from imaging the cross-hatched patterns precisely.

Thus, whenever the operator intends to measure and adjust the convergence of a new CRT set, the convergence should be adjusted by manually controlling the relative position with respect to the CRT set and the camera used for measurement. As a result, operating efficiency is lowered, which ultimately decreases productivity.

SUMMARY OF THE INVENTION

In order to solve the above-described problems, an object of the present invention is to provide a method of measuring convergence of a CRT which can adjust the convergence more easily by measuring misconvergence using dot patterns so as to minimize the influence of position control, graphically processing the amount of the measured misconvergence and displaying the misconvergence state.

Also, it is another object of the present invention to provide convergence measuring apparatus for a CRT most suitable for implementing the method of measuring convergence of a CRT according to the present invention.

To accomplish the above first object, the method of measuring convergence for a CRT according to the present invention comprises the steps of: generating a pattern signal for forming image patterns on a screen of a CRT by controlling a signal generator; forming image patterns by scanning the pattern signal into the screen of a target CRT for measurement of convergence; imaging the image patterns formed on the screen of the CRT by means of a plurality of cameras; selecting an image pattern perfectly positioned in the imaged region from among the imaged image patterns; signal-converting image information for the selected image pattern which is perfectly positioned within the imaged region; storing, interpreting and signal-processing the signal-converted image information; extracting data for misconvergence through the signal-processed image information; and displaying said extracted data on a monitor.

In the method of measuring convergence for a CRT according to the present invention, the signal generating means preferably generates dot patterns on a screen of the CRT. Each dot interval and size of the dot patterns formed on the screen of the CRT are preferably controlled arbitrarily. Also, the image pattern selecting step preferably includes the steps of reading luminance of the image patterns of the overall imaged region and adding both the horizontal luminance and the vertical luminance. The signal processing step preferably includes the steps of storing the signal-converted information for the selected image pattern in the signal processing means; and interpreting the stored information. Also, the data extracting step preferably includes the steps of extracting data for luminance centers of the R, G and B beams and changing the data into relative position data. The data displaying step preferably further includes the step of graphically processing the data.

To accomplish the other object, the convergence measuring apparatus for a CRT according to the present invention comprises: signal generating means for generating a signal for forming image patterns on a screen of a target CRT for measurement of convergence; controlling means for controlling the signal generating means to generate a pattern signal, scan the pattern signal on the screen of the CRT and form image patterns and for measuring the amount of misconvergence; a plurality of cameras for imaging the image patterns formed on the screen of the CRT; signal converting means for signal-converting the image information for the image patterns imaged by means of the plurality of cameras; signal processing means for storing the image information of the signal-converted image pattern, interpreting the image information and extracting data for the misconvergence; and a monitor for displaying the extracted data.

In the convergence measuring apparatus for the color CRT according to the present invention, the signal generating means preferably generates dot patterns on the screen of the CRT and is preferably capable of arbitrarily controlling each dot interval and size of the dot patterns formed on the screen of the CRT. Also, the signal generating means is preferably a pattern generator. The controlling means preferably processes data for the amount of misconvergence graphically and displays the data on a monitor.

BRIEF DESCRIPTION OF THE DRAWINGS

The above objects and advantages of the present invention will become more apparent by describing in detail a preferred embodiment thereof with reference to the attached drawings in which:

FIGS. 3 to 8 illustrate the operation of a convergence measuring apparatus for a color CRT according to the present invention and the measuring method therefor, in which FIG. 3 is a schematic block diagram of a convergence measuring apparatus for a color CRT according to the present invention, FIG. 5 is an enlarged state diagram of the imaged region shown in FIG. 4, FIG. 6 illustrates a method for selecting dots in the imaged region, FIG. 7 illustrates a method for extracting luminance centers of the R, G and B beams of the dots selected in the imaged region, and FIG. 8 is a flowchart for explaining the convergence measuring method for a color CRT according to the present invention.

DETAILED DESCRIPTION OF THE INVENTION

Figure 1:
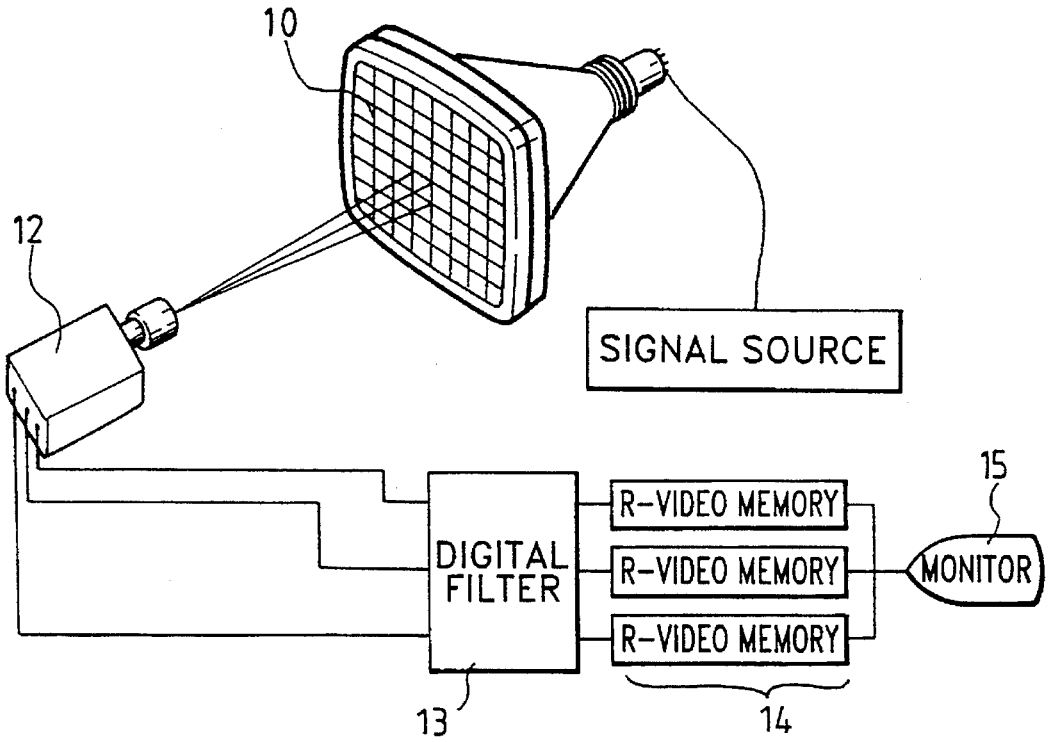
FIG.1(PRIOR ART)
FIG. 1 is a schematic block diagram of a conventional convergence measuring apparatus for a color CRT.
Figure 2:
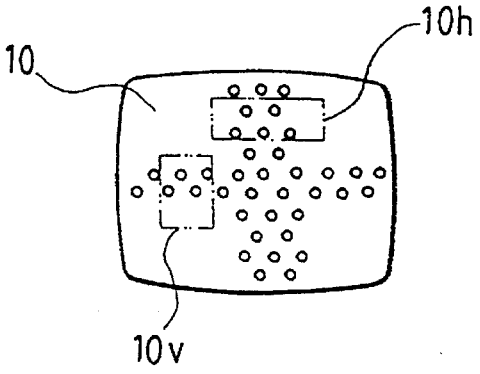
FIG.2(PRIOR ART)
FIG. 2 illustrates a conventional convergence measuring method for a color CRT.
Figure 3:
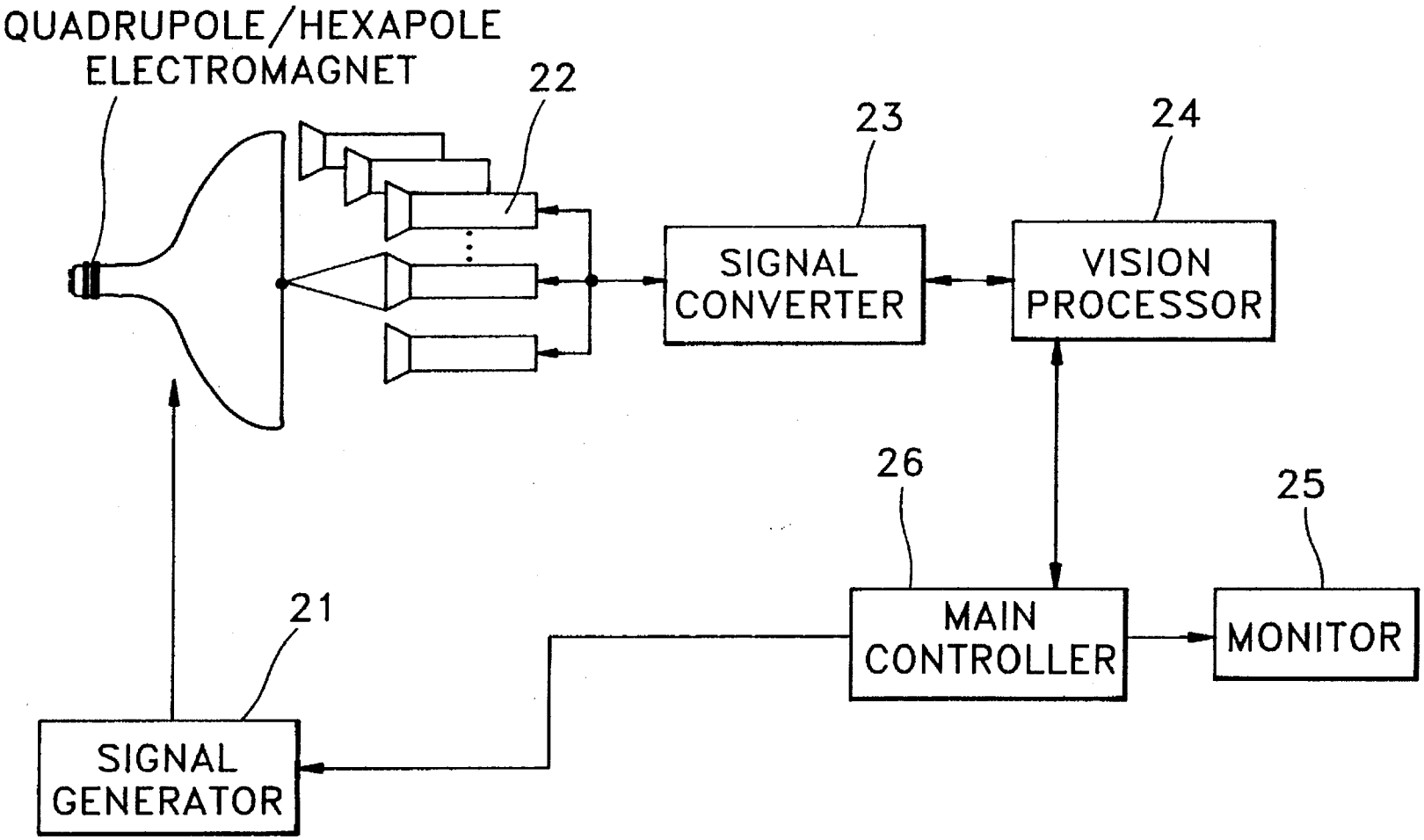

The convergence measuring apparatus for a color CRT according to the present invention includes a CRT 20 the convergence of which is subject to measurement, a signal generator 21 for generating a pattern signal, a main controller 26 for controlling the pattern signal of signal generator 21 to form dot patterns on a screen of CRT 20, a plurality of cameras for reading in image information of dot patterns displayed on the screen of CRT 20, a signal converter 23 for signal-converting the image information read by cameras 22, a vision processor 24 having a memory for storing the signal converted by signal converter 23 and a digital signal processor for interpreting and processing the signal stored in memory, and a monitor 25 for displaying in the data from the information processed by vision processor 24 and extracted as the amount of misconvergence of the R, G and B beams by main controller 26. Here, the dot patterns correspond to the cross-hatched patterns which conventionally form image patterns on the screen of a CRT for a convergence measurement.

The aforementioned convergence measuring apparatus for the color CRT according to the present invention operates based on the convergence measuring method for a color CRT to be described hereinbelow.

Figure 8:
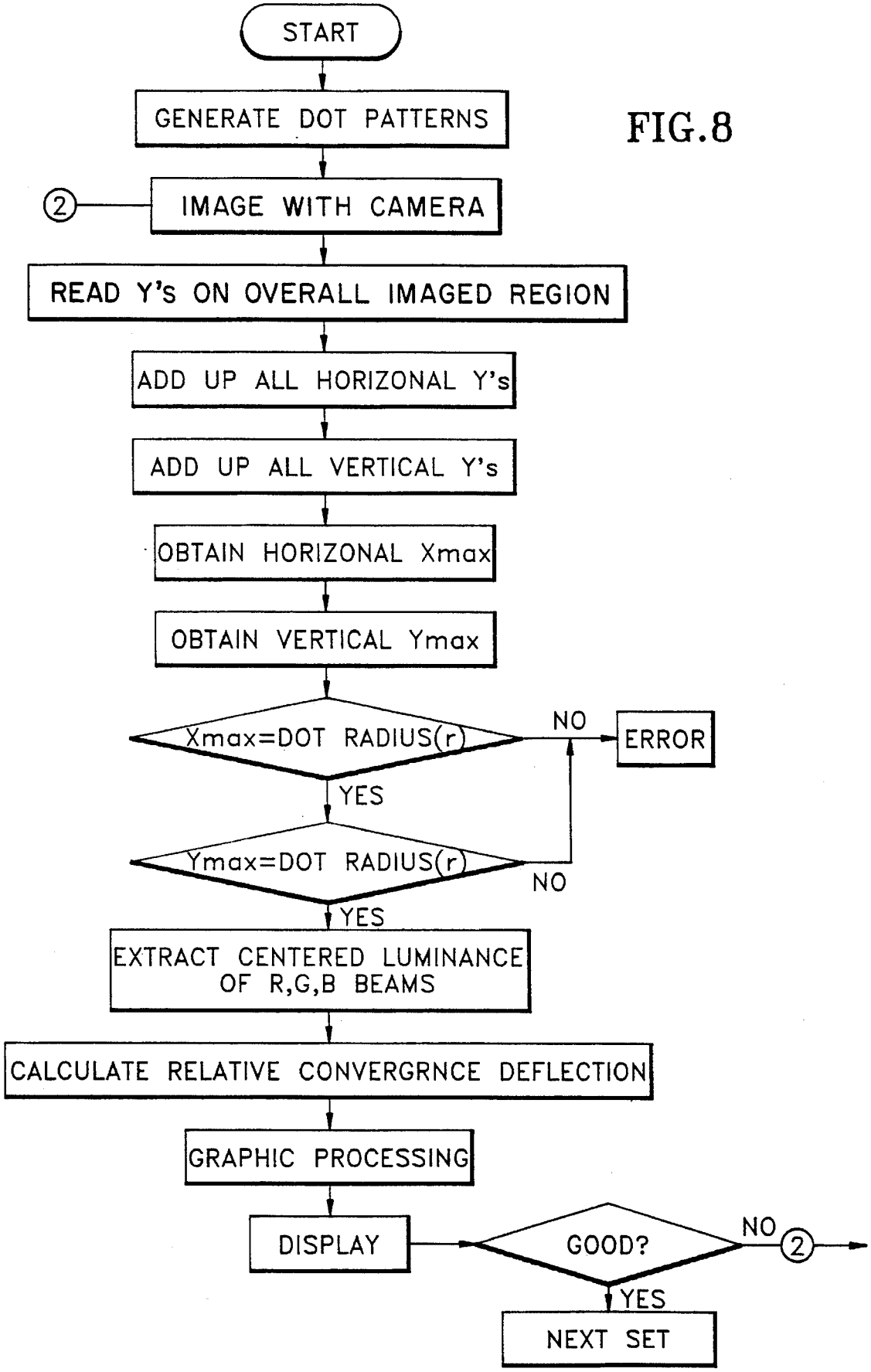

Through sequential operations shown in FIG. 8, a signal generator 21 for generating a pattern signal is controlled by a main controller 26 to generate a pattern signal for forming image patterns on the screen of a CRT 20 and form dot patterns, as shown in FIG. 4, by scanning the pattern signal onto the screen of the CRT.

Referring back to FIG. 4A, at least three pairs of R, G and B beams as dots should be controlled by their sizes for measuring convergence. Horizontal and vertical intervals of dot patterns can be controlled in one pixel unit. Regarding the target CRT's, a CRT for industrial use adopts a dot-type as shown in FIG. 4B, and a CRT for private use adopts a stripe-type as shown in FIG. 4C.

The dot patterns formed on the screen of the CRT are then imaged in respective imaged regions by means of a plurality of cameras.

Here, the imaged region (C in FIG. 4A) positioned in a portion of the CRT is imaged by a camera. The size of the imaged region is varied by changing the magnification of the camera lens according to dot pitch types.

In order to measure the convergence of the CRT, it is necessary to select a dot perfectly positioned in the imaged region among the dot patterns photographed.

Figure 4A:
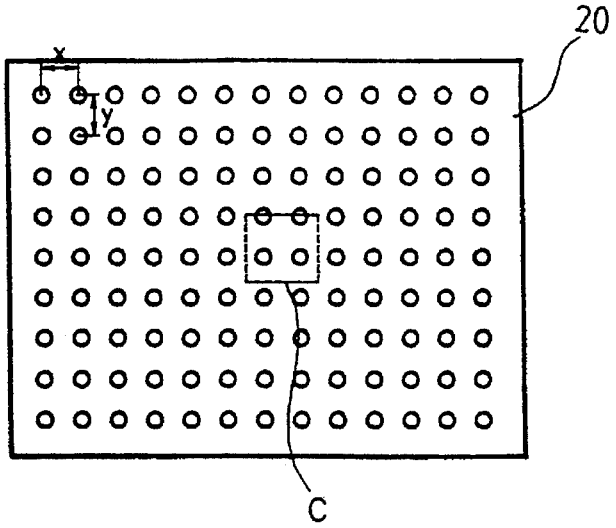
FIGS. 4A to 4C are state diagrams showing dot patterns displayed on a screen of the CRT in a uniform interval and imaged region.
Figure 4B:
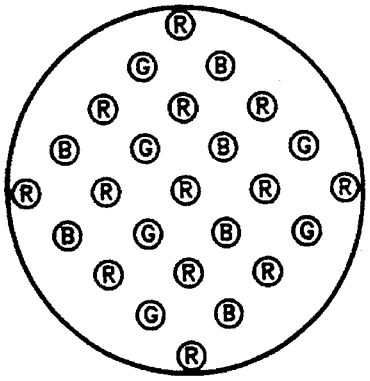
Figure 4C:
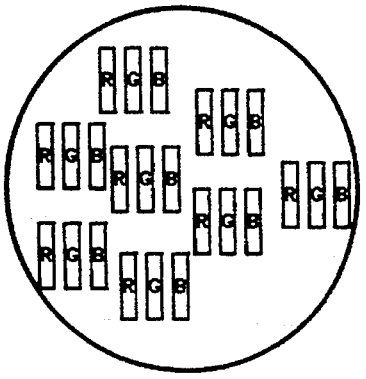
Figure 5:
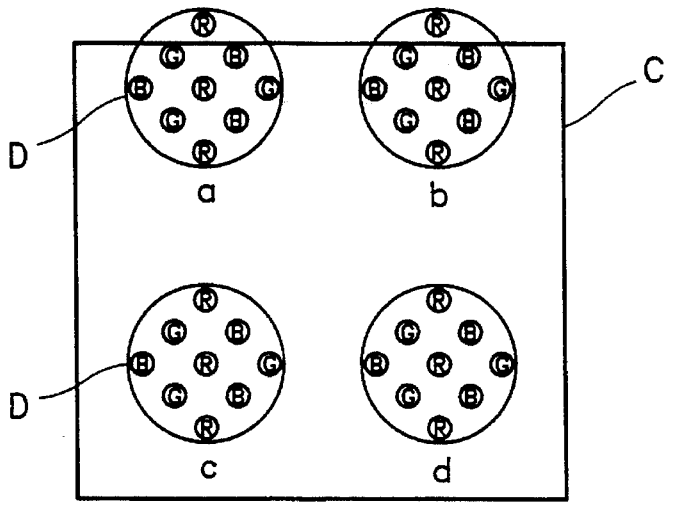

Referring to FIG. 5 which is an enlarged view of the imaged region shown in FIGS. 4A to 4C, among the dot patterns (D), two dots a and b in the imaged region (C) straddle the boundary and the other two dots c and d are perfectly inside the imaged region. In order to select the dots perfectly being inside the imaged region for a convergence measurement in the CRT, the plurality of cameras 22 image the dots displayed on the imaged region of the screen of CRT 20 and the information for the dot patterns are signal-converted by signal converter 23.

The method for selecting dots in the imaged region will now be described in detail with reference to FIG. 6.

Figure 6:
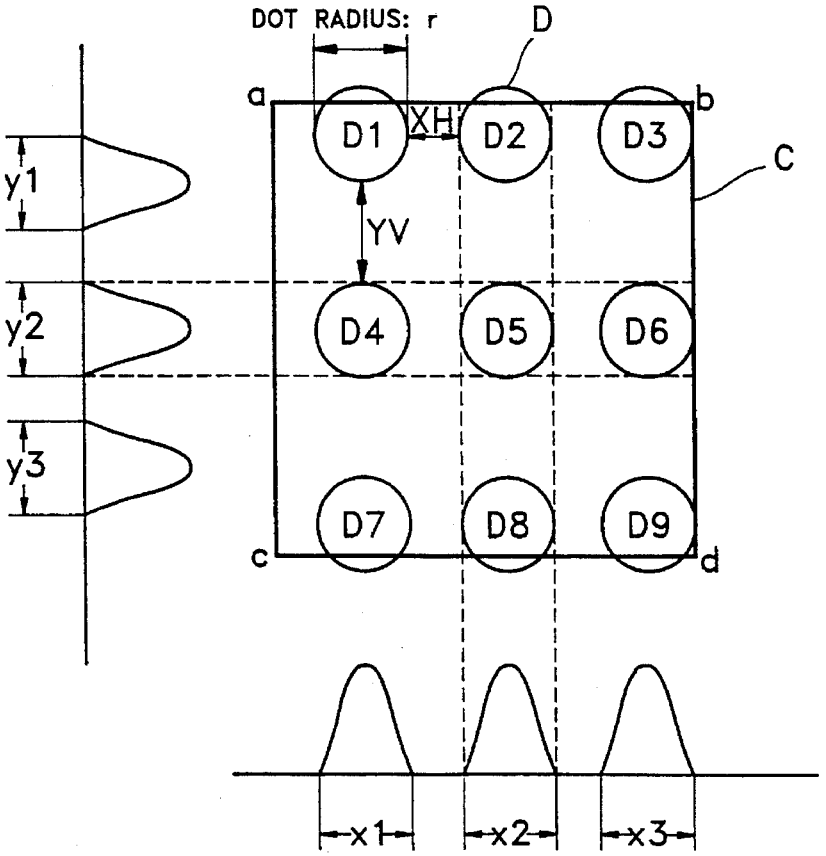

FIG. 6 shows the method for selecting dots in the case of nine dot patterns D1 to D9 which are inside or straddle the imaged region.

Here, reference letter C represents a imaged region, D represents a dot pattern, XH represents the space between the respective horizontal dots, (i.e., the portion having no luminance information) and YV represents the space between the respective vertical dots, (i.e., the portion having no luminance information).

In order to select dots being inside the imaged region, the values of Y (the luminance sum of the R, G and B beams), are read horizontally from point a to point b and vertically from point c to point d and are stored in a memory. Here, in order to curtail the dot selection time, by adopting the pre-counted space between the horizontal respective dots XH and the space between the vertical respective dots XV, the intervals having no dot are skipped.

By doing so, the sum of horizontal (X) and vertical (Y) values is obtained and the horizontal and vertical beam widths x1, x2, x3, y1, y2 and y3 respectively are obtained. Next, the maximum value of the widths in the respective directions, e.g., $X_{max}$=x2 (horizontal) and $Y_{max}$=y2 (vertical), is obtained. The dots in the intersection of the thus obtained maximum values of the two beam widths is determined to be the most perfect dot in the imaged region, i.e., not straddling the boundary. Here, if the maximum values of the two beam widths are the same, either one of the two values is selected.

Also, the known radius (r) of a dot and $X_{max}$ and $Y_{max}$ are compared, and by the magnitude difference, it is determined whether the state is normal or erroneous.

Next, the selected dot is stored in the memory incorporated in vision processor 24 and the image information of the stored dot is interpreted by the digital signal processor.

Figure 7:
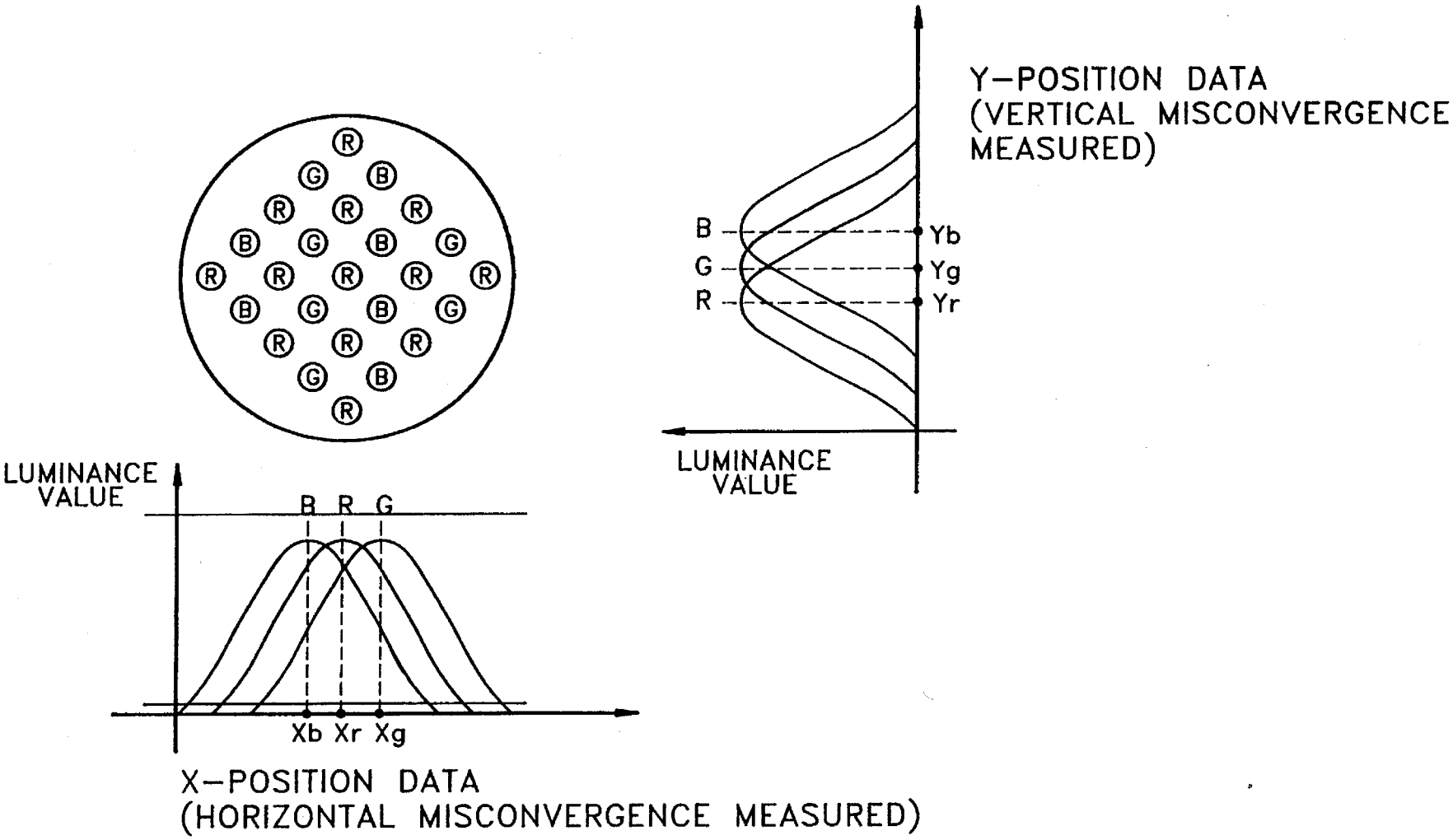

The luminance center of the R, G and B beams is extracted by the gravity center method as shown in FIG. 7 and the data for the relative position of the luminance center of the R, G and B beams is changed into data expressed in the unit of millimeters for measuring misconvergence.

Then, the misconvergence of the changed data is displayed on monitor 24 in the form of graphically processed data by means of main controller 26, so that an operator can adjust the convergence of the CRT using the displayed data.

As described above, according to the convergence measuring method for a CRT and the apparatus in use for the same, since the convergence is measured using dot patterns, it is not necessary to control precisely the relative position of a target CRT set for measurement of convergence with respect to cameras used for measurement thereof.

In measuring the convergence of a CRT, on each measurement of convergence of a new CRT, the operator does not need to readjust the relative position of a target CRT set for measurement of convergence and the cameras used for measurement thereof.

Therefore, since the convergence is easily measured and adjusted, the manufacturing efficiency is improved by the reduction of operating time.

It is to be understood the the above-described embodinment is merely illustrative of some of the many embodiments which represent the application of the principles of the present invention. Other arrangements can be devised by those skilled in the art without departing from the scope of the invention defined in the claims appended hereto.

What is claimed is:

1. A method of measuring convergence for a CRT comprising the steps of:

generating a pattern signal for forming image patterns on a screen of a CRT by controlling a signal generator;

forming image patterns by scanning said pattern signal into the screen of a target CRT for measurement of convergence;

imaging said image patterns formed on the screen of said CRT by means of a plurality of cameras;

selecting an image pattern perfectly positioned in an imaged region from among said imaged image patterns;

signal-converting image information for said selected image pattern which is perfectly positioned within said imaged region;

storing, interpreting and signal-processing said signal-converted image information;

extracting data for misconvergence through said signal-processed image information; and displaying said extracted data on a monitor.

2. A method of measuring convergence for a CRT as claimed in claim 1, wherein said image pattern selecting step includes the steps of reading the luminance of image patterns of the overall imaged region, adding the horizontal luminance and adding the vertical luminance.

3. A method of measuring convergence for a CRT as claimed in claim 1, wherein said signal processing step includes the steps of storing the signal-converted image information for said selected image pattern; and interpreting said stored information.

4. A method of measuring convergence for a CRT as claimed in claim 1, wherein said data extracting step includes the steps of extracting data for a luminance center of the R, G and B beams, and changing said data into relative position data.

5. A method of measuring convergence for a CRT as claimed in claim 1, wherein said data displaying step further includes a step of graphically processing said data.

6. A method of measuring convergence for a CRT as claimed in claim 1, wherein, in said pattern signal generating step, dot patterns are generated on the screen of said CRT using said signal generator.

7. A method of measuring convergence for a CRT as claimed in claim 2, wherein each dot interval and size of the dot patterns formed on the screen of said CRT are controlled arbitrarily.

8. A convergence measuring apparatus for a CRT comprising:

signal generating means for generating a signal for forming image patterns on a screen of a target CRT for measurement of convergence;

controlling means for controlling said signal generating means to generate a pattern signal, scan said pattern signal on the screen of said CRT and form image patterns, and for measuring the amount of misconvergence;

a plurality of cameras for imaging said image patterns formed on the screen of said CRT by means of said signal generating means;

signal converting means for signal-converting image information for said image patterns imaged by means of said plurality of cameras;

signal processing means for storing said image information of a signal-converted image pattern, interpreting said image information and extracting data for misconvergence; and a monitor for displaying said extracted data.

9. A convergence measuring apparatus for a color CRT as claimed in claim 8, wherein said signal generating means is a pattern generator.

10. A convergence measuring apparatus for a color CRT as claimed in claim 8, wherein said controlling means graphically processes data corresponding to the amount of misconvergence and displays said data on said monitor.

11. A convergence measuring apparatus for a color CRT as claimed in claim 8, wherein said signal generating means generates dot patterns on the screen of said CRT.

12. A convergence measuring apparatus for a color CRT as claimed in claim 11, wherein said signal generating means is a pattern generator.

13. A convergence measuring apparatus for a color CRT as claimed in claim 11, wherein said signal generating means is arbitrarily capable of controlling each dot interval and the size of said dot patterns formed on the screen of said CRT.

14. A convergence measuring apparatus for a color CRT as claimed in claim 13, wherein said signal generating means is a pattern generator.

* * * * *